US007251948B2

(12) United States Patent
Hyun et al.

(10) Patent No.: US 7,251,948 B2
(45) Date of Patent: Aug. 7, 2007

(54) PRESSURE EQUALIZER OF COMPRESSOR OF AIR CONDITIONER

(75) Inventors: Seung-Youp Hyun, Seoul (KR); Won-Hee Lee, Seoul (KR); Jeong-Taek Park, Gyeonggi-Do (KR); Chan-Ho Song, Gyeonggi-Do (KR); Yoon-Jei Hwang, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 175 days.

(21) Appl. No.: 11/104,612

(22) Filed: Apr. 13, 2005

(65) Prior Publication Data

US 2005/0235685 A1 Oct. 27, 2005

(30) Foreign Application Priority Data

Apr. 22, 2004 (KR) ..... 10-2004-0027941

(51) Int. Cl.
*F25B 41/00* (2006.01)

(52) U.S. Cl. ..... 62/196.1; 62/498; 137/512.1

(58) Field of Classification Search ..... 62/196.1, 62/498, 324.6; 137/115.01, 119.01, 512.1; 417/299, 311
See application file for complete search history.

(56) References Cited

U.S. PATENT DOCUMENTS

| | | | |
|---|---|---|---|
| 3,398,551 | A | 8/1968 | Yannascoli |
| 3,967,644 | A | 7/1976 | St. Laurent |
| 2002/0178741 | A1 | 12/2002 | Chumley et al. |

FOREIGN PATENT DOCUMENTS

| | | |
|---|---|---|
| EP | 1103296 | 5/2001 |

*Primary Examiner*—Mohammad M. Ali
(74) *Attorney, Agent, or Firm*—Greenblum & Bernstein, P.L.C.

(57) ABSTRACT

A pressure equalizer of a compressor of an air conditioner comprises a bypass pipe installed between a refrigerant suction pipe and a refrigerant discharge pipe of a compressor, a valve housing connected to a middle portion of the bypass pipe and provided with a partition having a valve hole therein, and a switching valve elastically installed in the valve housing for selectively opening the valve hole by a pressure difference between the refrigerant suction pipe and the refrigerant discharge pipe.

11 Claims, 6 Drawing Sheets

PRESSURE EQUALIZER OF COMPRESSOR OF AIR CONDITIONER

BACKGROUND OF THE INVENTION

1. Field of the Invention

The present invention relates to a pressure equalizer of a compressor of an air conditioner, and more particularly, to a pressure equalizer of a compressor of an air conditioner capable of shortening a waiting time for re-operating the air conditioner by solving a pressure difference between a refrigerant suction pipe and a refrigerant discharge pipe.

2. Description of the Conventional Art

Generally, an air conditioner has a refrigerating cycle such as a compression, a condensation, an expansion, and an evaporation. The air conditioner includes a compressor for converting a refrigerant of a low temperature and a low pressure into a refrigerant of a high temperature and a high pressure by a compression, a condenser for condensing a refrigerant of a high temperature and a high pressure into a liquid phase, an expander for converting a condensed refrigerant into a refrigerant of a low temperature and a low pressure by an expansion, and refrigerant pipes for connecting the compressor, the condenser, and the expander one another.

FIG. 1 is a conceptual view showing a refrigerating cycle of an air conditioner in accordance with the conventional art.

As shown, a refrigerating cycle of the conventional air conditioner includes a compressor 11 for compressing a refrigerant, a check valve 12 for preventing a backflow of a refrigerant discharged from the compressor 11, a condenser 30 for condensing a compressed refrigerant into a liquid phase, and an evaporator 40 for evaporating a condensed refrigerant.

An electronic expansion valve 50 for controlling a refrigerant flow according to a driving state of the compressor 11 is installed between the condenser 30 and the evaporator 40, and an accumulator 60 for preventing a liquid refrigerant that has not been vaporized from being introduced into the compressor 11 is installed between the evaporator 40 and the compressor 11.

An operation of the conventional air conditioner is as follows. First, the compressor 11 is operated to compress a refrigerant, and the compressed refrigerant is introduced into the condenser 30 via the check valve 12 to be condensed. Then, the condensed refrigerant is introduced into the evaporator 40 via the electronic expansion valve 50. Then, the refrigerant introduced into the evaporator 40 is vaporized to form cool air. The cool air is blown to the indoor room through a cool air blower (not shown) of an indoor unit.

FIG. 2 is a perspective view showing an outdoor unit of the air conditioner in accordance with the conventional art, and FIG. 3 is a perspective view showing a refrigerant suction pipe and a refrigerant discharge pipe connected to a compressor of the air conditioner in accordance with the conventional art.

As shown in FIG. 2, an outdoor unit 10 of the conventional air conditioner includes a compressor 11 for compressing a refrigerant into a high temperature and a high pressure, a condenser 30 for condensing a refrigerant of a high temperature and a high pressure, and an outdoor fan 14 for blowing external air to the condenser 30. An unexplained reference numeral 15 denotes a cover.

As shown in FIG. 3, a refrigerant suction pipe 2 connected to one side of the compressor 11 and a refrigerant discharge pipe 3 is connected to another side of the compressor 11.

The condenser 30 is connected to the refrigerant discharge pipe 3, and the evaporator 40 of FIG. 1 is connected to the refrigerant suction pipe 2. The accumulator 60 is installed at the refrigerant suction pipe 2 adjacent to the compressor 11.

As shown in FIGS. 1 to 3, in the conventional air conditioner, the compressor 11 is operated to suck a refrigerant from the evaporator 40 through the refrigerant suction pipe 2 and to compress. The compressed refrigerant is introduced into the condenser 30 via the check valve 12 through the refrigerant discharge pipe 3. Then, the refrigerant passes through the condenser 30 to be condensed, and then passes through the evaporator 40 to be vaporized thereby to form cool air. The cool air is blown to the indoor room through a cool air blower of an indoor unit. The refrigerant vaporized via the evaporator 40 is again introduced into the compressor 11 through the refrigerant discharge pipe 3 and the refrigerant suction pipe 2, which is repeated.

While the air conditioner is operated, the air conditioner need to be temporarily stopped as the air conditioner reaches a user's desired temperature or stopped in order to perform a defrosting operation for removing defrost unnecessarily formed during a cooling operation. At the time of the defrosting operation, the air conditioner is temporarily stopped to be re-operated. However, the air conditioner is not re-operated within a certain time due to a pressure difference between the refrigerant suction pipe and the refrigerant discharge pipe.

That is, when the air conditioner is temporarily stopped to be re-operated, the air conditioner is not immediately re-operated by a pressure difference between the refrigerant suction pipe and the refrigerant discharge pipe but is re-operated after solving the pressure difference for a certain time. Accordingly, it takes a lot of waiting time to re-operate the air conditioner. The above problem becomes severe by the check valve 12 installed at the refrigerant discharge pipe of the compressor. The check valve 12 prevents a backflow of a refrigerant at the time operating the air conditioner, but causes a pressure difference between the refrigerant suction pipe and the refrigerant discharge pipe to require a lot of waiting time at the time of re-operating the air conditioner.

SUMMARY OF THE INVENTION

Therefore, an object of the present invention is to provide a pressure equalizer of a compressor of an air conditioner capable of fast re-operating a compressor without a waiting time at the time of re-operating the air conditioner by solving a pressure difference between a refrigerant suction pipe and a refrigerant discharge pipe.

To achieve these and other advantages and in accordance with the purpose of the present invention, as embodied and broadly described herein, there is provided a pressure equalizer of a compressor of an air conditioner comprising: a bypass pipe installed between a refrigerant suction pipe and a refrigerant discharge pipe of a compressor; a valve housing connected to a middle portion of the bypass pipe and provided with a partition having a valve hole therein; and a switching valve elastically installed in the valve housing for selectively opening the valve hole by a pressure difference between the refrigerant suction pipe and the refrigerant discharge pipe.

The valve housing is provided with a valve guide having an opening at an inner wall thereof, and a spring is mounted in the opening. Also, the switching valve is preferably inserted into the opening of the valve guide to be supported by the spring.

The switching valve includes a head portion inserted into the valve hole, a tail portion stopped by a stopper formed at the end of the valve guide, and a body portion for connecting the head portion and the tail portion.

A diameter of the head portion of the switching valve is gradually decreased towards the refrigerant suction pipe from the refrigerant discharge pipe.

The partition is formed in the middle of the valve housing, and a pressure equalizing space is formed in the valve housing.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a pressure equalizer of a compressor of an air conditioner according to the present invention will be explained with reference to the attached drawings.

Figure 4:
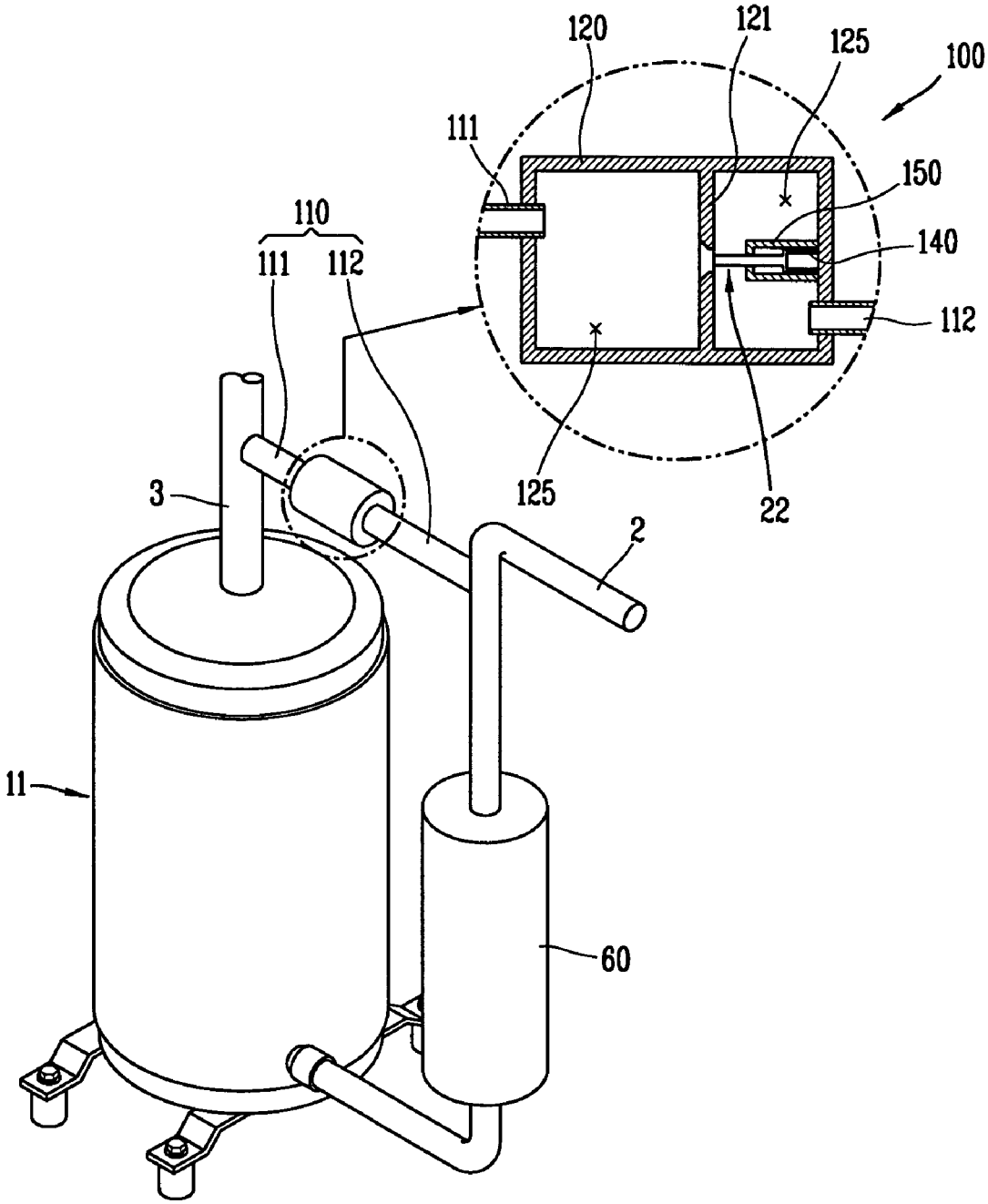
FIG. 4 is a perspective view showing a pressure equalizer of a compressor of an air conditioner according to the present invention.
Figure 5:
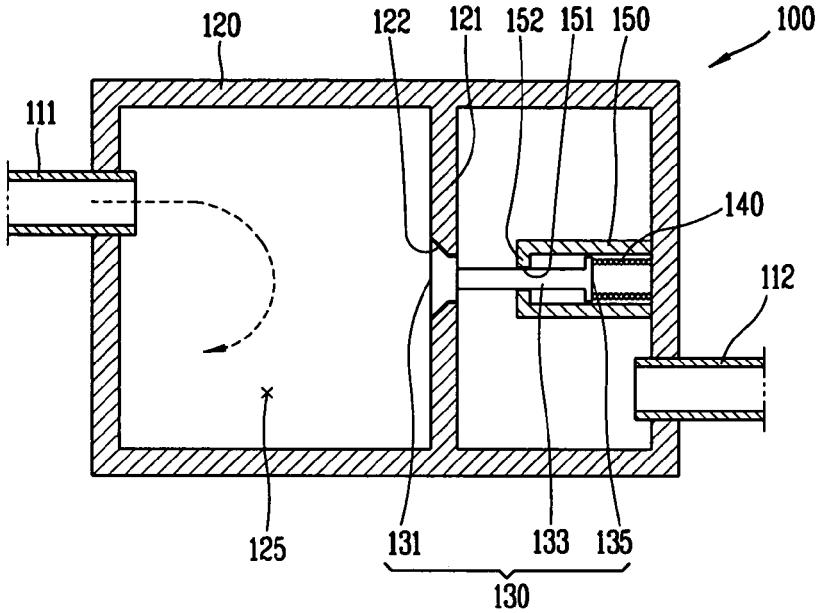
FIG. 5 is a sectional view showing a state that a valve hole of a valve housing is closed in the pressure equalizer of a compressor of an air conditioner according to the present invention.
Figure 6:
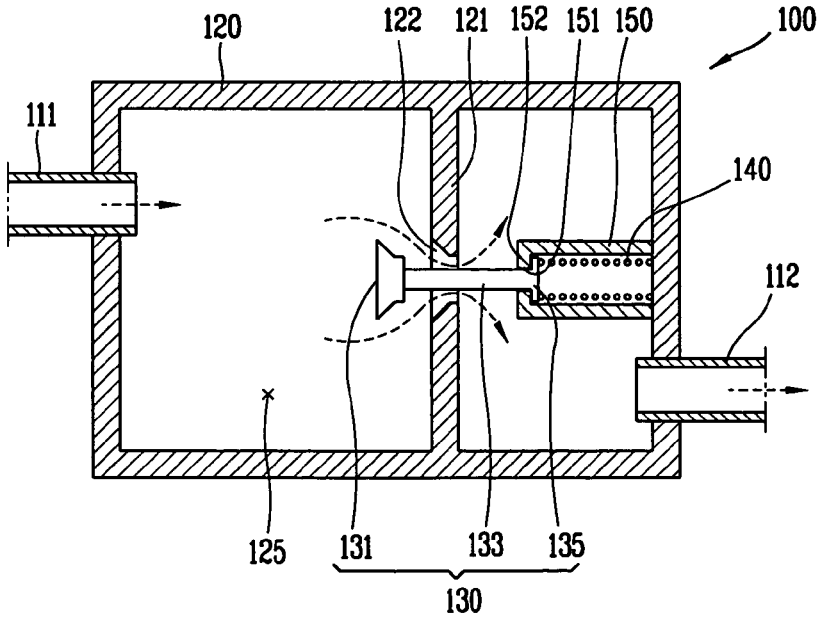
FIG. 6 is a sectional view showing a state that the valve hole of a valve housing is opened in the pressure equalizer of a compressor of an air conditioner according to the present invention.

FIG. 4 is a perspective view showing a pressure equalizer of a compressor of an air conditioner according to the present invention, FIG. 5 is a sectional view showing a state that a valve hole of a valve housing is closed in the pressure equalizer of a compressor of an air conditioner according to the present invention, and FIG. 6 is a sectional view showing a state that the valve hole of a valve housing is opened in the pressure equalizer of a compressor of an air conditioner according to the present invention.

As shown, a pressure equalizer 100 of a compressor of an air conditioner comprising: a bypass pipe 110 installed between a refrigerant suction pipe 2 and a refrigerant discharge pipe 3 of a compressor 11; a valve housing 120 connected to a middle portion of the bypass pipe 110 and provided with a partition having a valve hole 122 therein; and a switching valve 130 elastically installed in the valve housing 120 for selectively opening the valve hole 122 by a pressure difference between the refrigerant suction pipe 2 and the refrigerant discharge pipe 3.

The bypass pipe 110 is diverged from the refrigerant discharge pipe 3 to be installed between the refrigerant suction pipe 2 and the refrigerant discharge pipe 3, thereby connecting the refrigerant suction pipe 2 and the refrigerant discharge pipe 3.

The bypass pipe 110 includes a first bypass pipe 111 connected to the refrigerant discharge pipe 3 and a second bypass pipe 112 connected to the refrigerant suction pipe 2.

The valve housing 120 is installed in the middle of the bypass pipe 110. One side of the valve housing 120 is connected to the first bypass pipe 111 and another side of the valve housing 120 is connected to the second bypass pipe 112.

The partition 121 is formed at a middle portion inside the valve housing 120, and a valve hole 122 is formed in the middle of the partition 121.

A pressure equalizing space 125 is formed in the valve housing 120 by the partition 121, and a valve guide 150 is formed at an inner wall of the valve housing 120.

The valve guide 150 is formed at an inner wall of the valve housing 120, and is provided with an opening at the end thereof. A stopper 152 is formed at the opening.

A spring 140 and a switching valve 130 are installed in the valve guide 150 through the opening. Accordingly, the switching valve 130 is supported by the spring 140 in a state of being inserted into the valve guide 150.

The switching valve 130 includes a head portion 131 inserted into the valve hole 122, a tail portion 133 stopped by the stopper formed at the end of the valve guide, and a body portion 135 for connecting the head portion 131 and the tail portion 133.

A diameter of the head portion 131 of the switching valve 130 is gradually decreased towards the refrigerant suction pipe 2 from the refrigerant discharge pipe 3. That is, the head portion 131 is tapered towards the refrigerant suction pipe 2 from the refrigerant discharge pipe 3, thereby smoothly operating the switching valve 130.

A diameter of the valve hole 122 is equal to that of the head portion 131, and the valve hole 122 is preferably tapered towards the refrigerant suction pipe 2 from the refrigerant discharge pipe 3 so as to correspond to a shape of the switching valve 130.

An operation of the pressure equalizer of an air conditioner according to the present invention will be explained as follows.

Figure 1:
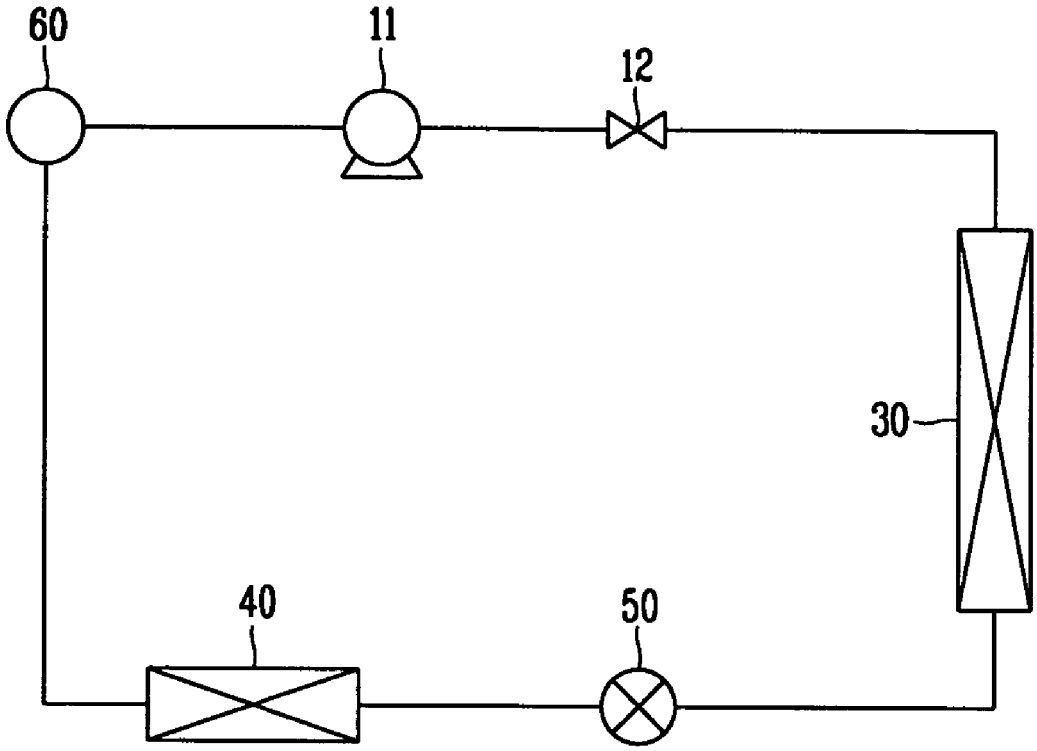
FIG. 1 CONVENTIONAL ART
FIG. 1 is a conceptual view showing a refrigerating cycle of an air conditioner in accordance with the conventional art.
Figure 2:
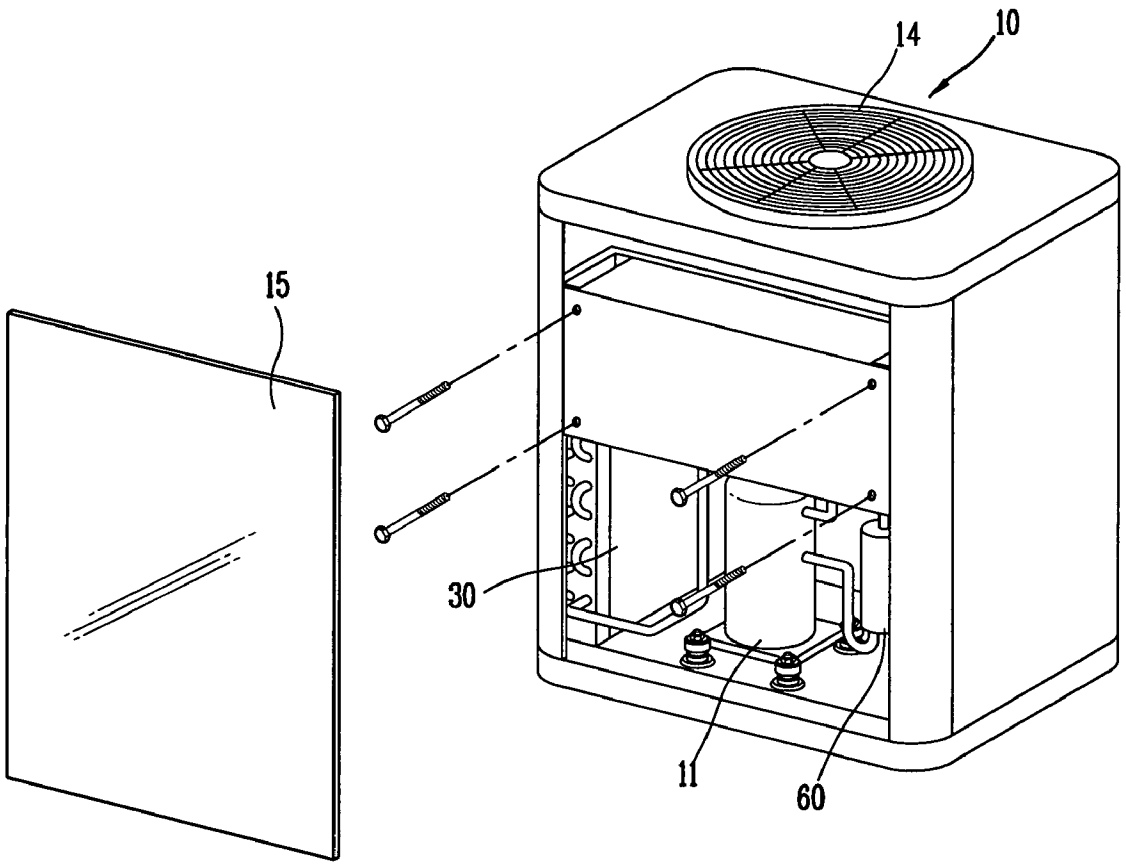
FIG. 2 CONVENTIONAL ART
FIG. 2 is a perspective view showing an outdoor unit of the air conditioner in accordance with the conventional art.
Figure 3:
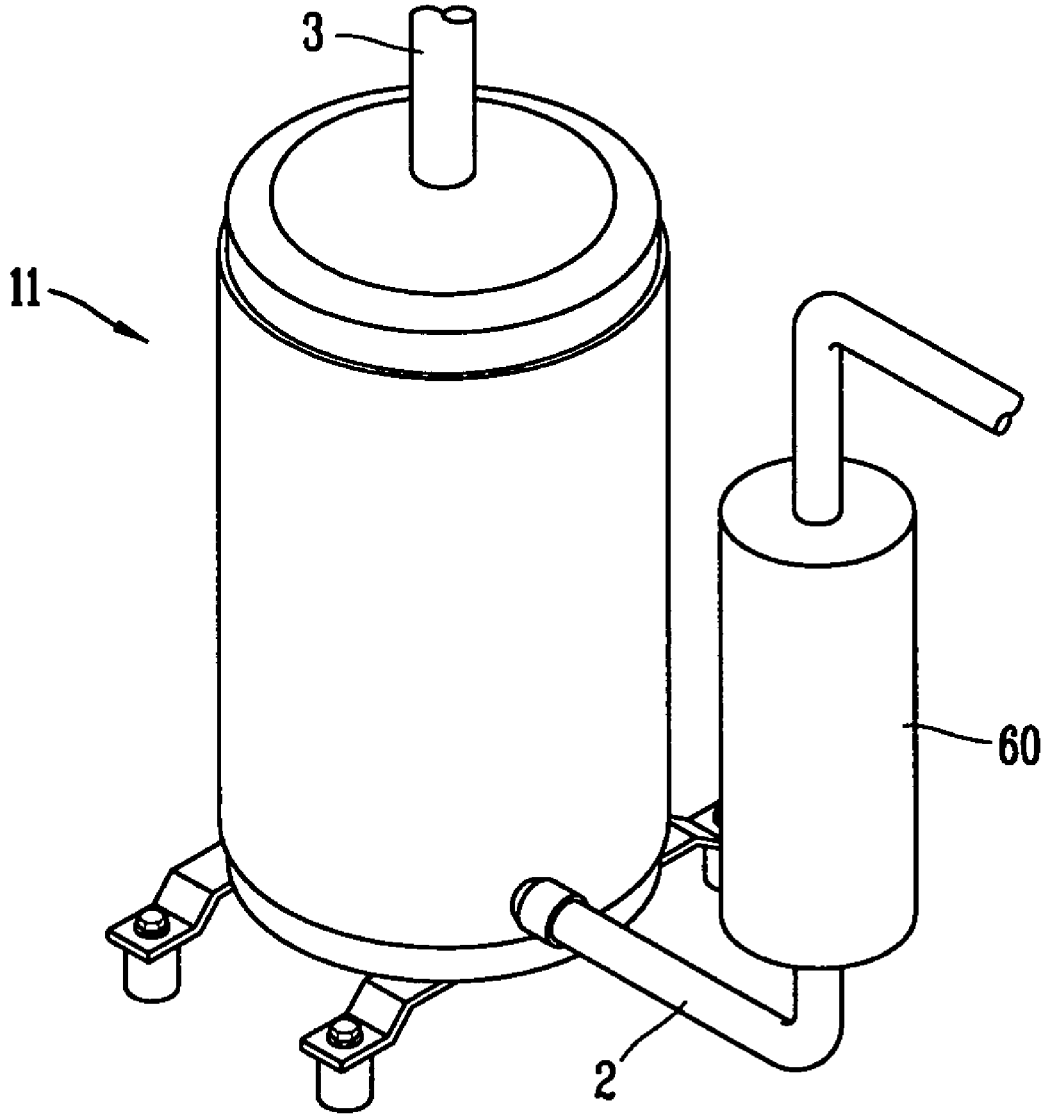
FIG. 3 CONVENTIONAL ART
FIG. 3 is a perspective view showing a refrigerant suction pipe and a refrigerant discharge pipe connected to a compressor of the air conditioner in accordance with the conventional art.

As shown in FIG. 1, the compressor 11 is operated to suck a refrigerant from the evaporator 40 through the refrigerant suction pipe 2 and to compress the refrigerant. The compressed refrigerant is introduced into the condenser 30 via the check valve 12 through the refrigerant discharge pipe 3 to be condensed. Then, the condensed refrigerant is introduced into the evaporator 40 is vaporized to form cool air. The cool air is blown to the indoor room through a cool air blower (not shown) of an indoor unit. The refrigerant vaporized via the evaporator 40 is again introduced into the compressor 11 through the refrigerant discharge pipe 3 and the refrigerant suction pipe 2, which is repeated.

As shown in FIGS. 4 and 5, while the air conditioner is normally operated, a force for pressurizing the switching valve 130 to the right side in drawing is greater than a force for pressurizing the switching valve 130 to the left side in drawing by an elastic coefficient of the spring 140. Accordingly, the switching valve 130 is moved to the right side. Under the state, the head portion 131 of the switching valve 130 covers the valve hole 122.

While the air conditioner is operated, the air conditioner need to be temporarily stopped as the air conditioner reaches a user's desired temperature or stopped in order to perform a defrosting operation for removing defrost unnecessarily formed during a cooling operation. At the time of the defrosting operation, the air conditioner is temporarily stopped to be re-operated.

As shown in FIGS. 4 to 6, when the compressor 11 of the air conditioner is stopped, a pressure of the refrigerant discharge pipe 3 is low thereby to decrease a pressure difference between the refrigerant discharge pipe 3 and the refrigerant suction pipe 2.

By the pressure difference between the refrigerant discharge pipe 3 and the refrigerant suction pipe 2, a force for pressurizing the switching valve 130 to the right side in drawing becomes less than a force for pressurizing the switching valve 130 to the left side in drawing by an elastic coefficient of the spring 140. Accordingly, the switching valve 130 is moved to the left side.

Under the state, the head portion 131 of the switching valve 130 opens the valve hole 122. At this time, a refrigerant of the refrigerant discharge pipe 3 is fast moved to the refrigerant suction pipe 2 thereby to solve the pressure difference between the refrigerant discharge pipe 3 and the refrigerant suction pipe 2, thus fast performing a pressure equalizing operation.

Figure 7:
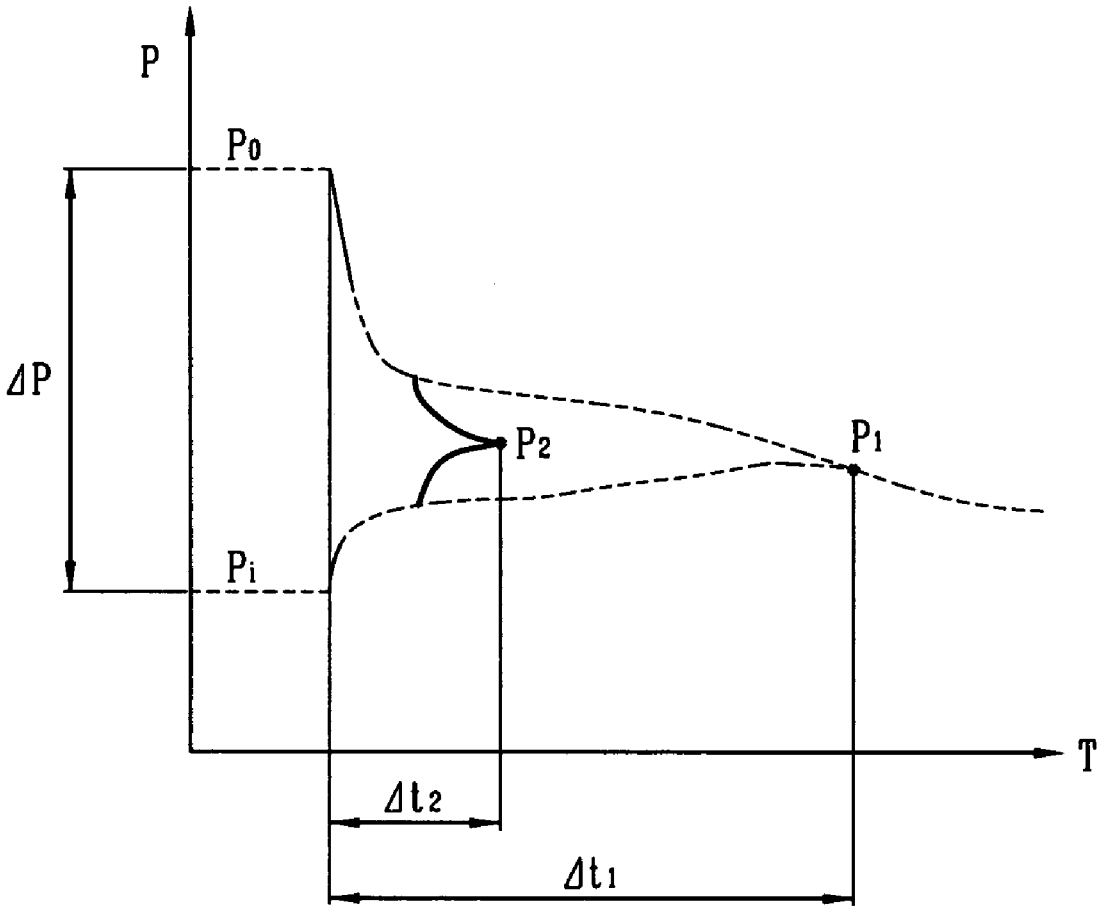
FIG. 7 is a graph showing a pressure change at a refrigerant suction pipe and a refrigerant discharge pipe in the pressure equalizer of a compressor of an air conditioner according to the present invention.

FIG. 7 is a graph showing a pressure change at a refrigerant suction pipe and a refrigerant discharge pipe in the pressure equalizer of a compressor of an air conditioner according to the present invention.

Referring to FIG. 7, the horizontal axis indicates a pressure equalizing time T and the vertical axis indicates a pressure difference ($\Delta P$) between a pressure Pi of the refrigerant suction pipe and a pressure Po of the refrigerant discharge pipe.

In the graph, P1 denotes a pressure equalizing point, that is, a point at which the pressure difference $\Delta P$ becomes zero in the conventional compressor of an air conditioner, and P2 denotes a pressure equalizing point in the compressor of an air conditioner according to the present invention.

In the graph, T denotes a pressure equalizing time, that is, a waiting time taken to perform a pressure equalizing operation for re-operating the compressor after the air conditioner is temporarily stopped.

In the conventional compressor of an air conditioner, it took $\Delta T1$ to solve the pressure difference ($\Delta P$) between the refrigerant suction pipe and of the refrigerant discharge pipe. However, in the compressor of an air conditioner according to the present invention, it took $\Delta T2$ to solve the pressure difference ($\Delta P$) between the refrigerant suction pipe and of the refrigerant discharge pipe. As shown in the graph, in the compressor of an air conditioner according to the present invention, the pressure equalizing time is greatly decreased thereby to fast re-operate the compressor.

As aforementioned, according to the pressure equalizer of the compressor of an air conditioner of the present invention, at the time of re-operating the air conditioner temporarily stopped as the air conditioner reaches a user's desired temperature or stopped in order to perform a defrosting operation for removing defrost unnecessarily formed during a cooling operation, the air conditioner is fast re-operated without a waiting time thereby to be operated more conveniently and efficiently.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A pressure equalizer of a compressor of an air conditioner comprising:

a bypass pipe installed between a refrigerant suction pipe and a refrigerant discharge pipe of a compressor;

a valve housing connected to a middle portion of the bypass pipe;

a partition stationarily disposed in the valve housing and formed with a valve hole; and a switching valve elastically installed in the valve housing for selectively opening the valve hole by a pressure difference between the refrigerant suction pipe and the refrigerant discharge pipe.

2. The pressure equalizer of claim 1, wherein the valve housing is provided with a valve guide having an opening at an inner wall thereof, a spring is mounted in the opening, and the switching valve is inserted into the opening of the valve guide to be supported by the spring.

3. The pressure equalizer of claim 1, wherein the switching valve comprises:

a head portion inserted into the valve hole;

a tail portion stopped by a stopper formed at an end of the valve guide; and a body portion for connecting the head portion and the tail portion.

4. The pressure equalizer of claim 1, wherein the head portion of the switching valve has a diameter gradually decreased towards the refrigerant suction pipe from the refrigerant discharge pipe.

5. The pressure equalizer of claim 1, wherein the head portion of the switching valve is formed to have the same diameter as that of the valve hole.

6. The pressure equalizer of claim 1, wherein the partition is formed at a middle portion of the valve housing, and a pressure equalizing space is formed in the valve housing.

7. A pressure equalizer of a compressor of an air conditioner comprising:

a bypass pipe installed between a refrigerant suction pipe and a refrigerant discharge pipe of a compressor;

a valve housing connected to a middle portion of the bypass pipe;

a partition stationarily disposed in the valve housing and formed with a valve hole;

a switching valve installed in the valve housing for selectively opening the valve hole by a pressure difference between the refrigerant suction pipe and the refrigerant discharge pipe; and a spring installed in the valve housing for supporting the switching valve.

8. The pressure equalizer of claim 7, wherein the valve housing is provided with a valve guide having an opening at an inner wall thereof, the spring is mounted in the opening of the valve guide, and the switching valve is inserted into the opening of the valve guide to be supported by the spring.

9. The pressure equalizer of claim 7, wherein the switching valve comprises:

a head portion inserted into the valve hole;

a tail portion stopped by a stopper formed at an end of the valve guide; and a body portion for connecting the head portion and the tail portion.

10. The pressure equalizer of claim 7, wherein the head portion of the switching valve has a diameter gradually decreased towards the refrigerant suction pipe from the refrigerant discharge pipe.

11. The pressure equalizer of claim 7, wherein the head portion of the switching valve is formed to have the same diameter as that of the valve hole.

* * * * *